US009480334B2

(12) United States Patent
Theisen et al.

(10) Patent No.: US 9,480,334 B2
(45) Date of Patent: Nov. 1, 2016

(54) MODULAR END DISPLAY

(71) Applicant: Target Brands, Inc., Minneapolis, MN (US)

(72) Inventors: Jennifer A. Theisen, Crystal, MN (US); Alex K. Poniatowski, Brooklyn Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 158 days.

(21) Appl. No.: 14/264,177

(22) Filed: Apr. 29, 2014

(65) Prior Publication Data

US 2015/0305520 A1 Oct. 29, 2015

(51) Int. Cl.

| | |
|---|---|
| ***A47B 87/02*** | (2006.01) |
| ***A47F 5/08*** | (2006.01) |
| ***A47F 5/00*** | (2006.01) |
| ***A47F 5/10*** | (2006.01) |

(52) U.S. Cl.

CPC ..... *A47B 87/0246* (2013.01); *A47F 5/0043* (2013.01); *A47F 5/08* (2013.01); *A47F 5/103* (2013.01)

(58) Field of Classification Search

CPC ..... A47F 5/106; A47F 5/105; A47F 5/101; A47F 5/08; A47F 5/103; A47B 87/0246

USPC ..... 211/90.02

See application file for complete search history.

(56) References Cited

U.S. PATENT DOCUMENTS 1,686,291 A * 10/1928 Moore ..... A47B 49/00 108/101
D143,660 S 1/1946 Irwin
D150,954 S 9/1948 Irwin
3,167,874 A 2/1965 Pogue
3,200,961 A 8/1965 Kolster et al.
3,234,896 A * 2/1966 Bonsall ..... A47B 87/0246 108/60
D212,399 S 10/1968 Kimler
3,408,128 A * 10/1968 Kump ..... A47B 47/04 211/184
D230,331 S 2/1974 Snyder
3,807,572 A * 4/1974 Luvara ..... A47B 47/042 108/110
3,836,009 A * 9/1974 Horowitz ..... A47B 47/0033 108/152
3,942,647 A 3/1976 Crosslen
D244,237 S 5/1977 Snyder
4,577,773 A * 3/1986 Bitel ..... A47B 88/20 206/561
4,611,866 A 9/1986 Everett
4,744,473 A 5/1988 Hardy
5,078,283 A 1/1992 Wilson
5,322,024 A 6/1994 Avery et al.
D363,623 S 10/1995 Rushing
5,588,541 A 12/1996 Goetz
D384,226 S 9/1997 Goetz
5,720,537 A * 2/1998 Lutz ..... A47B 87/0246 220/629
5,787,818 A * 8/1998 Letersky ..... A47B 55/06 108/153.1

(Continued)

*Primary Examiner* — Korie H Chan

(74) *Attorney, Agent, or Firm* — Leanne Taveggia Farrell; Westman, Champlin & Koehler, P.A.

(57) ABSTRACT

An end display includes a base, an end wall coupled to a rear of the base, a bottom shelf located on the base and secured to the end wall, at least one intermediate shelf spaced apart from the bottom shelf and secured to the end wall and at least one set of dividers. The bottom shelf includes a top having a tiered shelf structure. Each intermediate shelf includes a top having a tiered shelf structure and a bottom having a set of guides. The at least one set of dividers have bottom ends that are mounted to the tiered shelf structure of the bottom shelf and top ends that mate with the set of guides on the bottom of the at least one intermediate shelf.

17 Claims, 8 Drawing Sheets

(56) References Cited

U.S. PATENT DOCUMENTS

| | | | | |
|---|---|---|---|---|
| 5,836,760 | A * | 11/1998 | Turner | A47B 87/0246 432/253 |
| 5,921,190 | A | 7/1999 | Wood | |
| 7,128,379 | B1 * | 10/2006 | LaBonia, Jr. | A47B 47/0075 108/60 |
| 7,228,966 | B1 * | 6/2007 | Turner | A45D 40/24 132/315 |
| 7,249,746 | B2 * | 7/2007 | Awalt | A47F 7/145 108/92 |
| 7,819,069 | B2 | 10/2010 | Tanaka et al. | |
| D656,759 | S | 4/2012 | Landa | |
| D685,206 | S | 7/2013 | Hawkins | |
| D690,968 | S | 10/2013 | Hawkins | |
| 8,561,419 | B2 | 10/2013 | Navarro et al. | |
| 2004/0094439 | A1 * | 5/2004 | Dauphinais | A47B 81/068 206/307 |
| 2010/0078401 | A1 | 4/2010 | Vulpitta | |
| 2011/0163050 | A1 | 7/2011 | Grove | |

* cited by examiner

MODULAR END DISPLAY

BACKGROUND

Businesses, such as retail stores, use a variety of types of display structures to present products and related information to customers for purchase. One kind of display unit is a gondola. Gondola display units are constructed of, but are not limited to, uprights, back panels and base decks. At the end of a gondola display unit is an end display or end cap.

The discussion above is merely provided for general background information and is not intended to be used as an aid in determining the scope of the claimed subject matter.

SUMMARY

An end display includes a base, an end wall coupled to a rear of the base, a bottom shelf located on the base and secured to the end wall, at least one intermediate shelf spaced apart from the bottom shelf and secured to the end wall and at least one set of dividers. The bottom shelf includes a top having a tiered shelf structure. Each intermediate shelf includes a top having a tiered shelf structure and a bottom having a set of guides. The at least one set of dividers have bottom ends that are mounted to the tiered shelf structure of the bottom shelf and top ends that mate with the set of guides on the bottom of the at least one intermediate shelf.

An end display includes a first product support assembly having a shelf deck and at least one riser and a plurality of second product support assemblies spaced apart from each other and located above the first product support assembly. Each second product support assembly includes a shelf deck and at least one riser and provides upwardly facing product support surfaces and at least one downwardly facing channel. The end display further includes a plurality of partitions. At least one of the partitions is mounted to the riser of the first product support assembly and mates with the at least one downwardly facing channel of one of the second product support assemblies. At least one of the partitions is mounted to the riser of one of the second product support assemblies and mates with the at least one downwardly facing channel of another one of the second product support assemblies.

A method of assembling an end display includes mounting a first set of dividers to a tiered shelf structure of a bottom shelf such that the first set of dividers are spaced apart from each other and extend from fixed ends to free ends and mounting a second set of dividers on a tiered shelf structure of an intermediate shelf such that the second set of dividers are spaced apart from each other and extend from fixed ends to free ends. The method further includes setting the bottom shelf on a base deck of the end display and securing the bottom shelf to an end wall coupled to a rear of the base deck of the end display. The method further includes securing the intermediate shelf to the end wall above and spaced apart from the bottom shelf such that the free ends of the first set of dividers mate with guides located on a bottom of the intermediate shelf.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In a business or a retail store, display structures are used to display products or merchandise. A gondola end display or gondola end cap is one type of display structure that displays merchandise at an end of an aisle. A gondola end display includes a pair of uprights, an end panel and a base deck. To display products on a gondola end display, shelves can be attached to and supported by slots in the pair of uprights so that they extend across the end display. For certain kinds of products, such as pharmaceutical products, a tiered arrangement and/or divided shelf arrangement is desired for displaying products on an end display rather than standard shelves.

The end display described in detail below is a modular end display that is configurable into different display configurations and includes a bottom shelf having a tiered shelf structure, at least one intermediate shelf having a tiered shelf structure and dividers that partition the bottom shelf and the intermediate shelf. In a first display configuration, the modular end display has a greater height than the modular end display in a second display configuration. The first display configuration is accomplished by using a greater number of intermediate shelves than the number of intermediate shelves in the second display configuration and includes a header.

Figure 1:
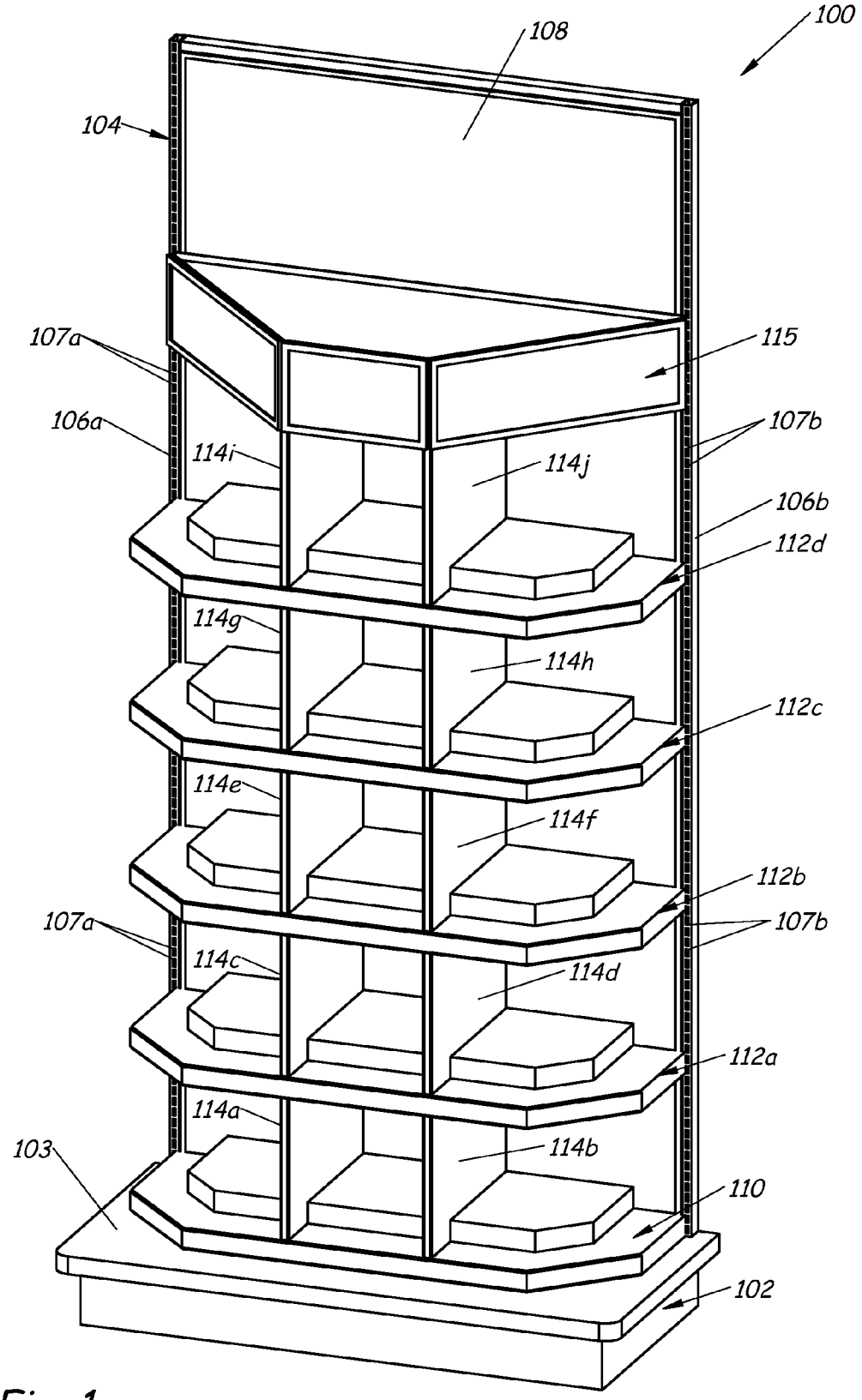
FIG. 1 is a perspective view of a modular end display in accordance with an embodiment.

FIG. 1 is a perspective view of a modular end display 100 in accordance with one embodiment. Modular end display 100 includes a base or base deck 102 and an end wall 104 coupled to a rear of base 102. End wall 104 includes a pair of uprights 106*a* and 106*b* located at the rear of base 102 and support an end panel 108 located between uprights 106*a* and 106*b*. The pair of uprights 106*a* and 106*b* includes a plurality of slots 107*a* and 107*b*, respectively. Modular end display 100 further includes a bottom shelf or first product support assembly 110, a plurality of intermediate shelves or second product support assemblies 112*a-d*, a plurality of dividers or partitions 114*a-j* and a header 115.

Bottom shelf 110 is located on a top surface 103 of base 102 and is secured to end wall 104 with a pair of shelf brackets (FIGS. 3-7). A left shelf bracket engages with a slot 107*a* in upright 106*a* and a right shelf bracket engages with a slot 107*b* in upright 106*b*. In the embodiment illustrated in FIG. 1, modular end display 100 includes four intermediate shelves 112*a-d*. It should be realized, however, that modular end display 100 can include any number of intermediate shelves including at least one intermediate shelf. In FIG. 1, first or lowermost intermediate shelf 112*a* is located above and spaced apart from bottom shelf 110 and is secured to end wall 104 with a pair of shelf brackets (illustrated in FIGS. 8-12). Second intermediate shelf 112*b* is located above and spaced apart from first or lowermost intermediate shelf 112*a* and is secured to end wall 104 with a pair of shelf brackets. Third intermediate shelf 112*c* is located above and spaced apart from second intermediate shelf 112*b* and is secured to end wall 104 with a pair of shelf brackets. Fourth or uppermost intermediate shelf 112*d* is located above and spaced apart from third intermediate shelf 112*c* and is secured to end wall 104 with a pair of shelf brackets. Header 115 is located above and spaced apart from fourth or uppermost intermediate shelf 112*d*.

In the embodiment illustrated in FIG. 1, dividers or partitions 114*a-j* are divided into sets of two with the bottom ends or fixed ends of each pair of dividers mounted to a respective shelf 110 or 112*a-d* and the top ends or free ends of each pair of dividers engaged with a respective shelf 112*a-d* or header 115. For example, the bottom ends of a first set of dividers 114*a* and 114*b* mount to bottom shelf 110 and the top ends of dividers 114*a* and 114*b* engage or mate with first or lowermost intermediate shelf 112*a*. The bottom ends of a second set of dividers 114*c* and 114*d* mount to first intermediate shelf 112*a* and the top ends of dividers 114*c* and 114*d* engage or mate with second intermediate shelf 112*b*. The bottom ends of a third set of dividers 114*e* and 114*f* mount to second intermediate shelf 112*b* and the top ends of dividers 114*c* and 114*d* engage or mate with third intermediate shelf 112*c*. The bottom ends of a fourth set of dividers 114*g* and 114*h* mount to third intermediate shelf 112*d* and the top ends of dividers 114*g* and 114*h* engage or mate with fourth or uppermost intermediate shelf 112*e*. The bottom ends of a fifth set of dividers 114*i* and 114*j* mount to fourth intermediate shelf 112*d* and the top ends of dividers 114*i* and 114*j* engage or mate with header 115. Although each set of dividers is shown above as having two dividers, it should be realized that each set of dividers can include more or less than two dividers. In addition, although each set of dividers is shown as having the same number of dividers in other embodiment, one set of dividers can have a different number of divers than other sets of dividers in the same end display.

Figure 2:
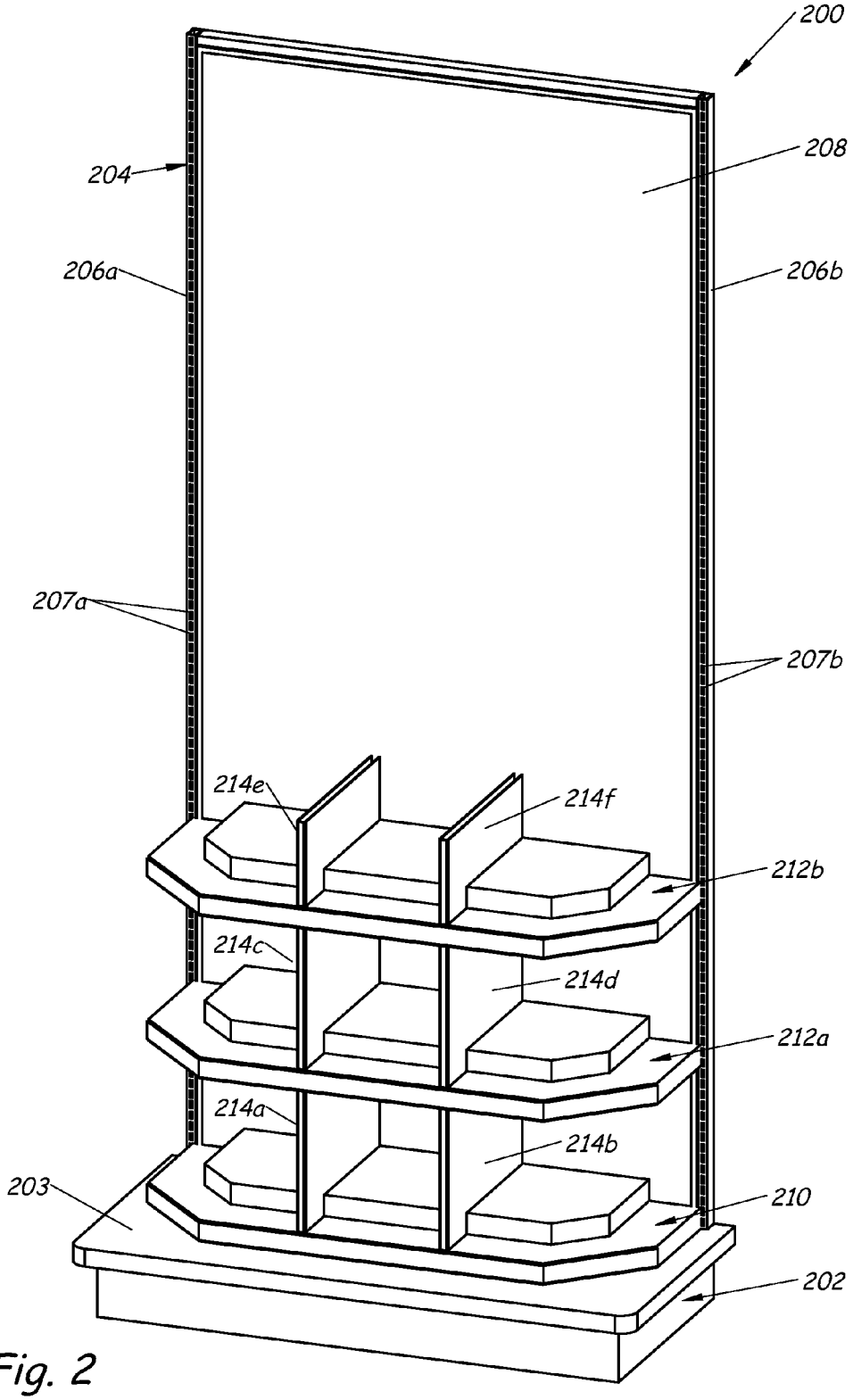
FIG. 2 is a perspective view of a modular end display in accordance with another embodiment.

FIG. 2 is a perspective view of a modular end display 200 in accordance with another embodiment. Modular end display 200 includes a base or base deck 202 and an end wall 204 coupled to a rear of base 202. End wall 204 includes a pair of uprights 206*a* and 206*b* located at the rear of base 202 and an end panel 208 located between and supported by uprights 206*a* and 206*b*. The pair of uprights 206*a* and 206*b* includes a plurality of slots 207*a* and 207*b*, respectively. Modular end display 200 further includes a bottom shelf or first product support assembly 210, a plurality of intermediate shelves or second product support assemblies 212*a* and 212*b* and a plurality of dividers or partitions 214*a-f*.

Bottom shelf 210 is located on a top surface 203 of base 202 and is secured to end wall 204 with a pair of shelf brackets (FIGS. 3-7). A left shelf bracket engages with a slot 207*a* in upright 206*a* and a right shelf bracket engages with a slot 207*b* in upright 206*b*. In the embodiment illustrated in FIG. 2, modular end display 200 includes two intermediate shelves 212*a* and 212*b*. It should be realized, however, that modular end display 200 can include any number of intermediate shelves including at least one intermediate shelf. In FIG. 2, first or lowermost intermediate shelf 212*a* is located above and spaced apart from bottom shelf 210 and is secured to end wall 204 with a pair of shelf brackets (illustrated in FIGS. 8-12). Second or uppermost intermediate shelf 212*b* is located above and spaced apart from first or lowermost intermediate shelf 212*a* and is secured to end wall 204 with a pair of shelf brackets. In the embodiment illustrated in FIG. 2, dividers or partitions 214*a-f* are divided into sets of two with the bottom ends or fixed ends of the dividers mounted to a shelf and the top ends or free ends of the dividers engaged or mated with a shelf. For example, the bottom ends of a first set of dividers 214*a* and 214*b* mount to bottom shelf 210 and the top ends of dividers 214*a* and 214*b* engage or mate with first intermediate shelf 212*a*. The bottom ends of a second set of dividers 214*c* and 214*d* mount to first intermediate shelf 212*a* and the top ends of dividers 214*c* and 214*d* engage or mate with second intermediate shelf 212*b*. The bottom ends of a third set of dividers 214*e* and 214*f* mount to second intermediate shelf 212*b* and the top ends of dividers 214*e* and 214*f* are free. Although each set of dividers is shown above as having two dividers, it should be realized that each set of dividers can include more or less than two dividers. In addition, although each set of dividers is shown as having the same number of dividers in other embodiment, one set of dividers can have a different number of divers than other sets of dividers in the same end display.

Figure 3:
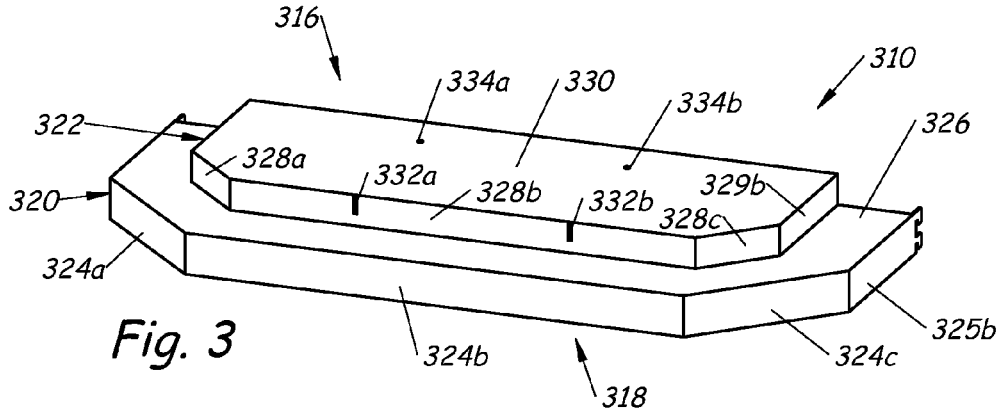
FIG. 3 is a perspective view of an exemplary bottom shelf that can be used with the modular end displays illustrated in FIG. 1 or 2.
Figure 4:
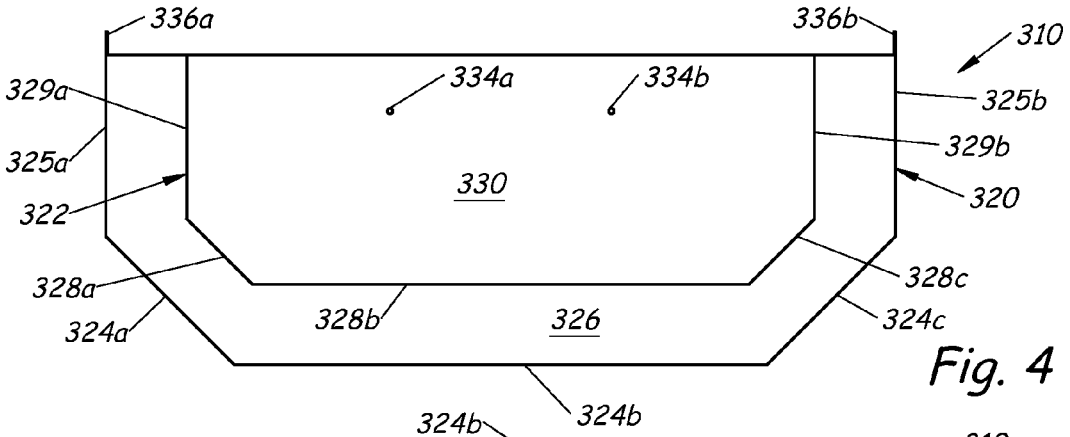
FIG. 4 is a top view of the bottom shelf illustrated in FIG. 3.
Figure 5:
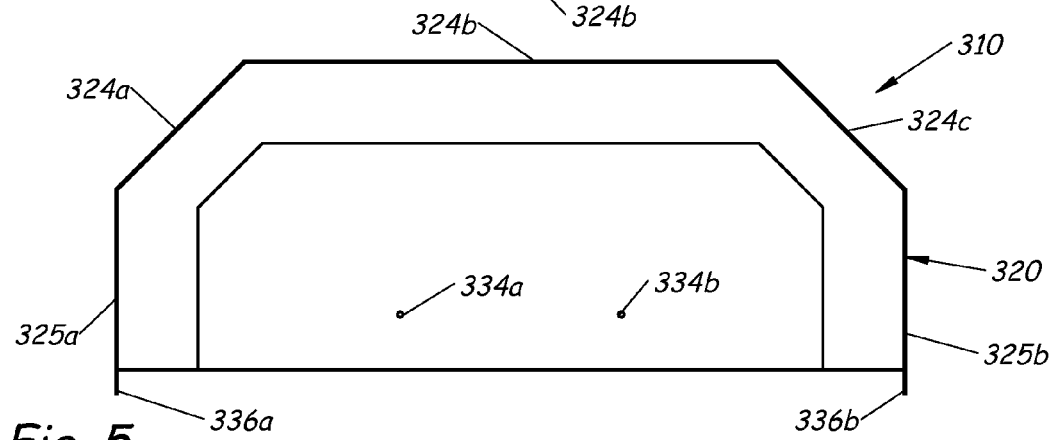
FIG. 5 is a bottom view of the bottom shelf illustrated in FIG. 3.
Figure 6:
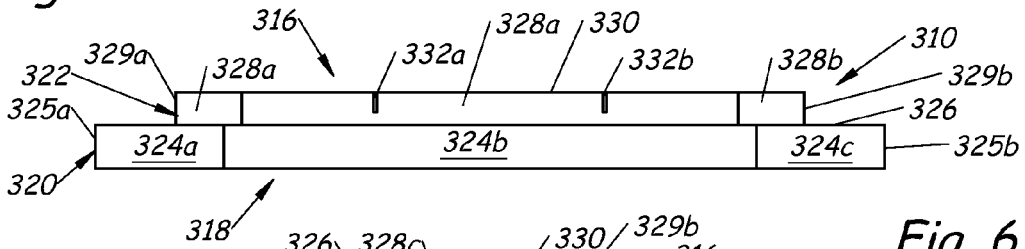
FIG. 6 is a front view of the bottom shelf illustrated in FIG. 3.
Figure 7:
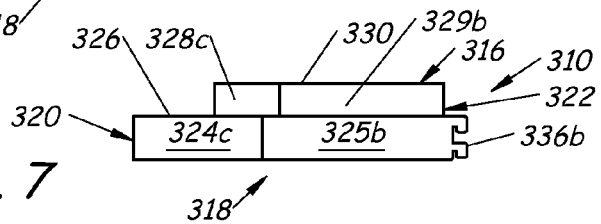
FIG. 7 is a side view of the bottom shelf illustrated in FIG. 3.

FIG. 3 is a perspective view of an exemplary bottom shelf or first product support assembly 310 that can be used with the modular end displays 100 and 200 illustrated in FIGS. 1 and 2. FIG. 4 is a top view, FIG. 5 is a bottom view, FIG. 6 is a front view and FIG. 7 is a right side view of bottom shelf 310 (the left side view being a mirror image). Bottom shelf 310 includes a top 316 having a tiered shelf structure and a bottom 318. The tiered shelf structure of bottom shelf 310 includes a main deck or shelf deck 320 and a step deck or riser 322. Main deck 320 includes front facing surfaces

324*a-c*, side facing surfaces 325*a* and 325*b* and an upwardly facing support surface 326. Step deck 322 includes front facing surfaces 328*a-c*, side facing surfaces 329*a* and 329*b* and an upwardly facing support surface 330. Upwardly facing support surface 330 of step deck 322 is positioned above or raised above upwardly facing support surface 326 of main deck 320 by front facing surfaces 328*a-c* and side facing surfaces 329*a* and 329*b* of step deck 320. Upwardly facing support surface 326 of main deck 320 is defined between side facing surface 325*a* and side facing surface 329*a*, between side facing surface 325*b* and side facing surface 329*b* and between front facing surfaces 324*a-c* and front facing surfaces 328*a-c*.

Step deck 322 includes a set of slots 332*a* and 332*b* that extend through front facing surface 328*b*. While FIGS. 3-7 illustrate bottom shelf 310 having two slots 332*a* and 332*b*, bottom shelf 310 can have any number of slots configured to receive a portion of a divider for securing the divider to bottom shelf 310. Step deck 322 also includes a set of holes 334*a* and 334*b* that extend through upwardly facing surface 330. While FIGS. 3-7 illustrate step deck 322 having two holes 334*a* and 334*b*, step deck 310 can have any number of holes with each hole configured to receive a fastener for additionally securing a portion of a divider to bottom shelf 310.

Bottom shelf 310 includes a set of brackets 336*a* and 336*b* consisting of a left side bracket 336*a* and a right side bracket 336*b*. As previously discussed, bottom shelf 310 is configured to rest on a base or base deck, such as base deck 102 or 202 in FIGS. 1 and 2, and be secured to an end wall, such as end wall 104 or 204 in FIGS. 1 and 2, by inserting the ends of brackets 336*a* and 336*b* into slots in uprights, such as slots 107*a* and 107*b* in FIG. 1 and slots 207*a* and 207*b* in FIG. 2.

Figure 8:
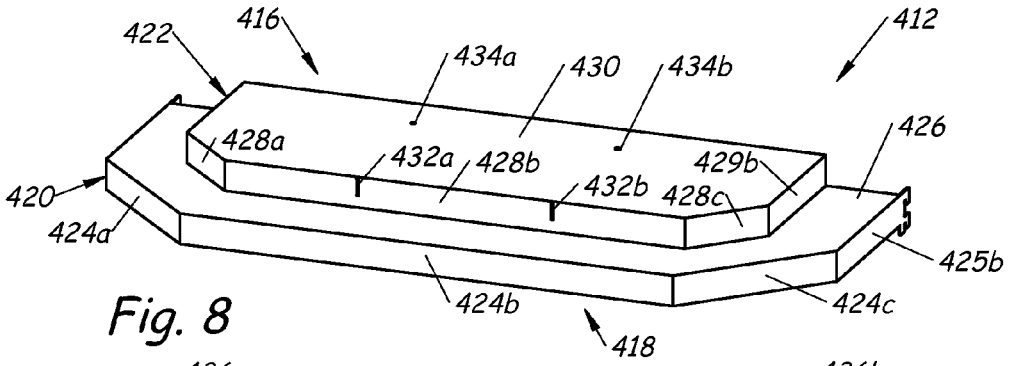
FIG. 8 is a perspective view of an exemplary intermediate shelf that can be used with the modular end displays illustrated in FIG. 1 or 2.
Figure 9:
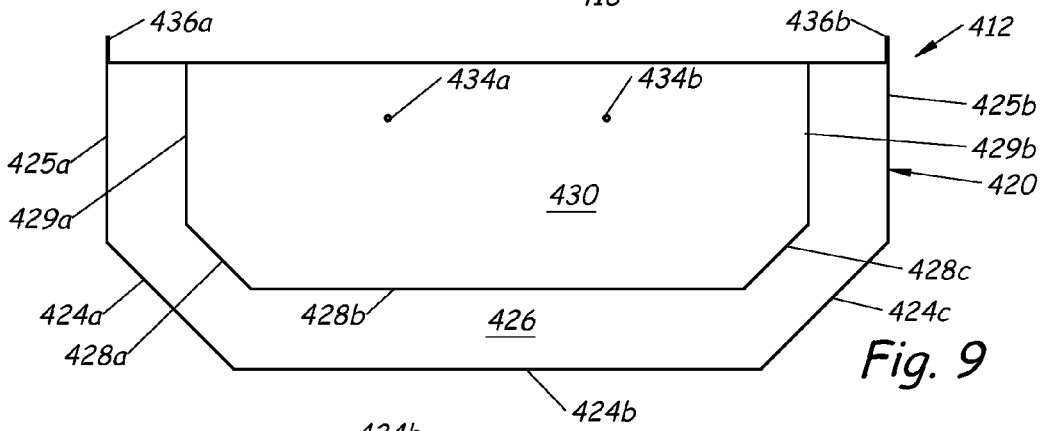
FIG. 9 is a top view of the intermediate shelf illustrated in FIG. 8.
Figure 10:
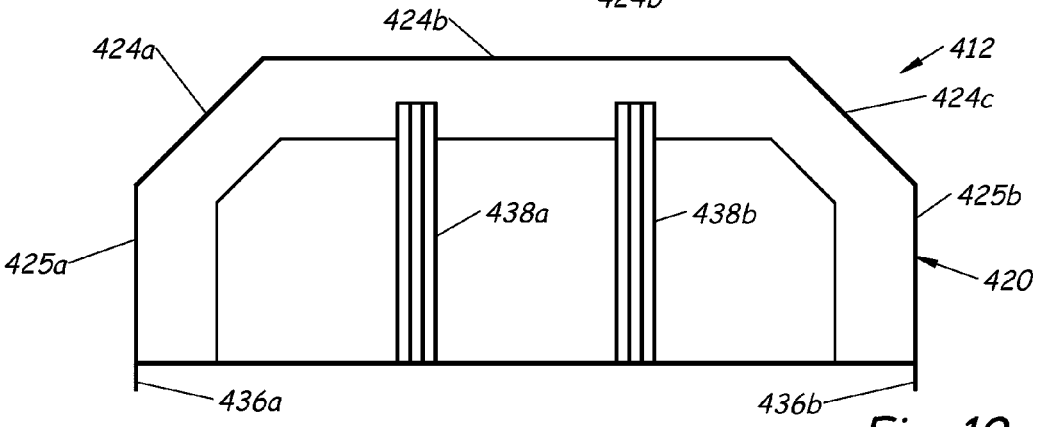
FIG. 10 is a bottom view of the intermediate shelf illustrated in FIG. 8.
Figure 11:
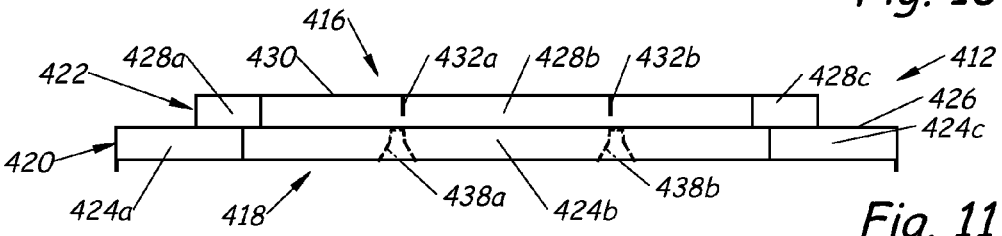
FIG. 11 is a front view of the intermediate shelf illustrated in FIG. 8.
Figure 12:
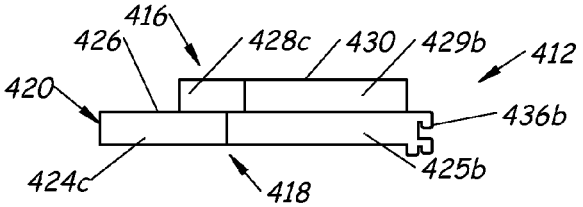
FIG. 12 is a side view of the intermediate shelf illustrated in FIG. 8.

FIG. 8 is a perspective view of an exemplary intermediate shelf or second product support assembly 412 that can be used with the modular end displays 100 and 200 illustrated in FIG. 1 or 2. FIG. 9 is a top view, FIG. 10 is a bottom view, FIG. 11 is a front view and FIG. 12 is a right side view of intermediate shelf 412 (the left side view being a mirror image). The tiered shelf structure of intermediate shelf 412 includes a top 416 having a tiered shelf structure and a bottom 418. Intermediate shelf 412 includes a main deck or shelf deck 420 and a step deck or riser 422. Main deck 420 includes front facing walls 424*a-c*, side facing surfaces 425*a* and 425*b* and an upwardly facing support surface 426. Step deck 422 includes front facing surfaces 428*a-c*, side facing surfaces 429*a* and 429*b* and an upwardly facing support surface 430. Upwardly facing support surface 430 of step deck 422 is positioned above or raised above upwardly facing support surface 426 of main deck 420 by front facing surfaces 428*a-c* and side facing surfaces 429*a* and 429*b* of step deck 420. Upwardly facing support surface 426 of main deck 420 is defined between side facing surface 425*a* and side facing surface 429*a*, between side facing surface 425*b* and side facing surface 429*b* and between front facing surfaces 424*a-c* and front facing surfaces 428*a-c*.

Step deck 422 includes a set of slots 432*a* and 432*b* that extend through front facing surface 428*b*. While FIGS. 8-12 illustrate step deck 422 having two slots 432*a* and 432*b*, step deck 422 can have any number of slots configured to receive a portion of a divider for securing the divider to intermediate shelf 412. Step deck 422 also includes a set of holes 434*a* and 434*b* that extend through upwardly facing surface 430. While FIGS. 8-12 illustrate step deck 422 having two holes 434*a* and 434*b*, step deck 422 can have any number of holes configured to receive fasteners for additionally securing a portion of a divider to intermediate shelf 412.

Intermediate shelf 412 includes a set of brackets consisting of a left side bracket 436*a* and a right side bracket 436*b*. As previously discussed, intermediate shelf 412 is secured to an end wall, such as end wall 104 or 204 in FIGS. 1 and 2, by inserting the ends of brackets 436*a* and 436*b* into slots in uprights, such as slots 107*a* and 107*b* in FIG. 1 and slots 207*a* and 207*b* in FIG. 2.

Intermediate shelf 412 also includes a set of guides or downwardly facing channels 438*a* and 438*b*. Guides 438*a* and 438*b* are located on a bottom 418 of intermediate shelf 412 and are shown in solid lines in FIG. 10 and in phantom lines in FIG. 11. Each guide 438*a* and 438*b* is configured to receive or mate with a top end or free end of one of the dividers 114*a-h* in FIG. 1 or one of the dividers 214*a-d* in FIG. 2. In this way, while intermediate shelf 412 is secured to end wall using left and right side brackets 436*a* and 436*b*, bottom 418 of intermediate shelf 412 rests on top ends of a set of dividers.

Figure 13:
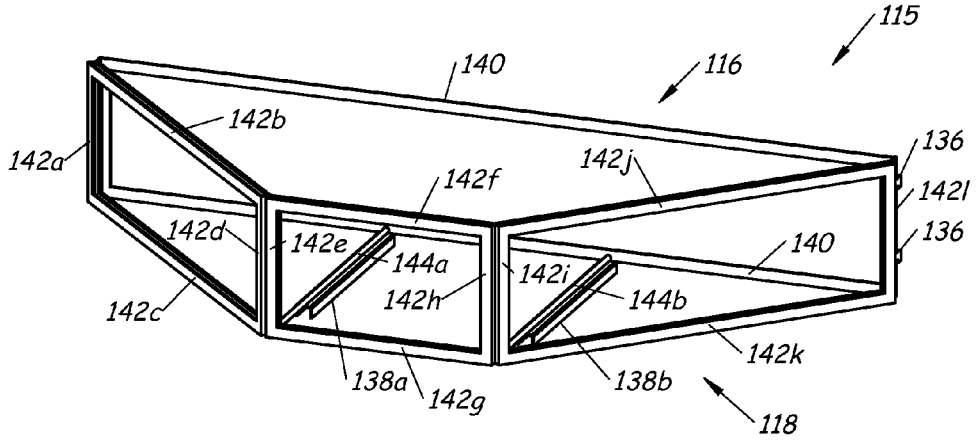
FIG. 13 is a perspective view of an exemplary header that can be used with the modular end display illustrated in FIG. 1.

FIG. 13 is a perspective view of header 115 of modular end display 100 illustrated in FIG. 1. Header 115 includes a plurality of span members 140*a* and 140*b* that define a back of header 115, a plurality of sign frame members 142*a-l* and a plurality of bottom frame members 144*a* and 144*b*. Sign frame members 142*a-d* together provide a support for holding a marketing sign so that the marketing sign faces at an angle that is between a left side and a front of header 115. Sign frame members 142*e-h* together provide a support for holding a marketing sign so that the marketing sign faces front. Sign frame members 142*i-l* together provide a support for holding a marketing sign so that the marketing sign faces at an angle that is between a right side and the front of header 115. Span members 140*a* and 140*b* connect frame member 142*a* to frame member 142*l*.

Header 115 includes a set of brackets consisting of a left side brackets (not illustrated) and a right side brackets 136*b*. Header 115 is secured to end wall 104 in FIG. 1 by inserting the ends of the brackets into slots in uprights, such as slots 107*a* and 107*b* in FIG. 1.

Header 115 also includes a set of guides or downwardly facing channels 138*a* and 138*b* that are coupled to bottom frame members 144*a* and 144*b*, respectively. Guides 138*a* and 138*b* are located on a bottom 118 of header 115. Each guide 138*a* and 138*b* is configured to receive or mate with a top end or free end of one of the dividers 114*i* and 114*j* in FIG. 1. In this way, while header 115 is secured to end wall 104 using left and right side brackets, bottom 118 of header 115 rests on top ends of a set of dividers.

Figure 14:
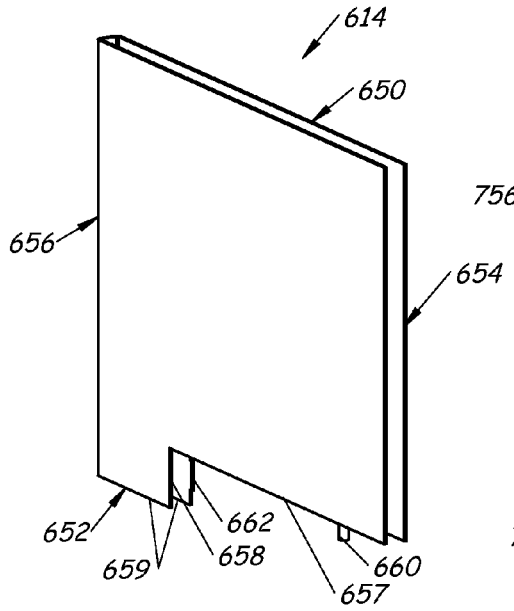
FIG. 14 is a perspective view of an exemplary right divider of one of the set of dividers that can be used with the modular end displays illustrated in FIGS. 1 and 2.
Figure 15:
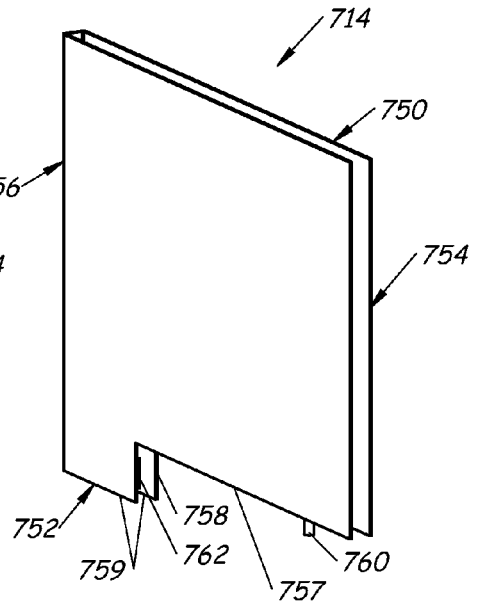
FIG. 15 is a perspective view of an exemplary left divider of one of the set of dividers that can be used with the modular end displays illustrated in FIGS. 1 and 2.

FIG. 14 is a perspective view of an exemplary right or right-hand divider 614. FIG. 15 is a perspective view of an exemplary left or left-hand divider 714. Together dividers 614 and 714 form a set of exemplary dividers that can be used with modular end displays 100 and 200 illustrated in FIGS. 1 and 2. More specifically, divider 614 can be used for dividers 114*b*, 114*d*, 114*f*, 114*h* and 114*j* in modular end display 100 and for dividers 214*b* and 214*d* in modular end display 200. Divider 714 can be used for dividers 114*a*, 114*c*, 114*e*, 114*g* and 114*i* in modular end display 100 and for dividers 214*a* and 214*c* in modular end display 200. Dividers 214*e* and 214*f*, which are the top most dividers in modular end display 200 and are mounted to the riser of the upper most intermediate shelf 212*b* have the same configuration as exemplary dividers 614 and 714, however, dividers 214*e* and 214*f* have a height that is less than a height of exemplary dividers 614 and 714 and dividers 114*a-j* and 214*a-d*.

As illustrated in FIG. 14 and in one embodiment, right divider 614 includes a top or free end 650, a bottom or fixed end 652, a back end 654 and a front end 656. Bottom or fixed end 652 is mounted to the tiered shelf structure of a bottom shelf, such as bottom shelf 310, or an intermediate shelf, such as intermediate 412, and includes three portions. A first portion 657 mounts to and is in contact with upwardly facing support surface 330 of exemplary riser 322 or upwardly facing support surface 430 of exemplary riser 422 and includes tab 662. A second portion 658 mounts to and is in contact with forward facing surface 328*b* of exemplary riser 322 or forward facing surface 428*b* of exemplary riser 422. A third portion 659 rests on or is in contact with upwardly facing support surface 326 of exemplary main deck 320 or upwardly facing support surface 426 of exemplary main deck 420. Back end 654 of right divider 614 faces the back of modular end displays 100 and 200, front end 656 faces the front of modular end displays 100 and 200 and top end 650 is a free end that engages with or mates with a guide on the shelf located above the shelf to which divider 614 is mounted.

To mount divider 614 to exemplary risers 322 or 422, a fastener 660 located on and connected to first portion 657 of bottom end 652 mates with hole 334*b* or 434*b* in exemplary risers 320 or 420 of bottom shelf 310 or intermediate shelf 412. To further secure divider 614 to exemplary risers 322 or 422, tab 662 located on second portion 658 of bottom end 652 mates with slot 332*b* or 432*b* in exemplary risers 320 or 420 of bottom shelf 310 or intermediate shelf 412.

As illustrated in FIG. 15 and in one embodiment, left divider 714 includes a top or free end 750, a bottom or fixed end 752, a back end 754 and a front end 756. Bottom or fixed end 752 is mounted to the tiered shelf structure of a bottom shelf, such as bottom shelf 310, or an intermediate shelf, such as intermediate shelf 412, and includes three portions. A first portion 757 mounts to and is in contact with upwardly facing support surface 330 of exemplary riser 322 or upwardly facing support surface 430 of exemplary riser 422 and includes tab 762. A second portion 758 mounts to and is in contact with forward facing surface 328*b* of riser 322 or forward facing surface 428*b* of exemplary riser 422. A third portion 759 rests on or is in contact with upwardly facing support surface 326 of exemplary main deck 320 or upwardly facing support surface 426 of exemplary main deck 420. Back end 754 of left divider 714 faces the back of modular end displays 100 and 200, front end 756 faces the front of modular end displays 100 and 200 and top end 750 is a free end that engages with or mates with a guide on the shelf located above the shelf to which divider 714 is mounted.

To mount divider 714 to exemplary risers 322 or 422, a fastener 760 located on first portion 757 of bottom end 752 mates with hole 334*a* or 434*a* in exemplary risers 320 or 420 of bottom shelf 310 or intermediate shelf 412. To further secure divider 714 to exemplary risers 322 or 422, tab 762 located on second portion 758 of bottom end 752 mates with slot 332*a* or 432*a* in risers 320 or 420 of bottom shelf 310 or intermediate shelf 412.

As illustrated in FIGS. 14 and 15 and in one embodiment, the main bodies of dividers 614 and 714 (i.e., not including fasteners 660 and 760) are made from a single piece of folded sheet material, such as sheet metal. In this embodiment, ends 650, 750, 652, 752, 654 and 754 of each divider 614 and 714 include two thicknesses of sheet material separated by a space, while ends 656 and 756 include the connecting bends and portions of the sheet material. This configuration allows tabs 662 and 762 to be made of a single thickness of sheet material and be relatively hidden from exterior sides of modular end displays 100 and 200. It should be realized, however, that other configurations of dividers 614 and 714 are possible.

Figure 16:
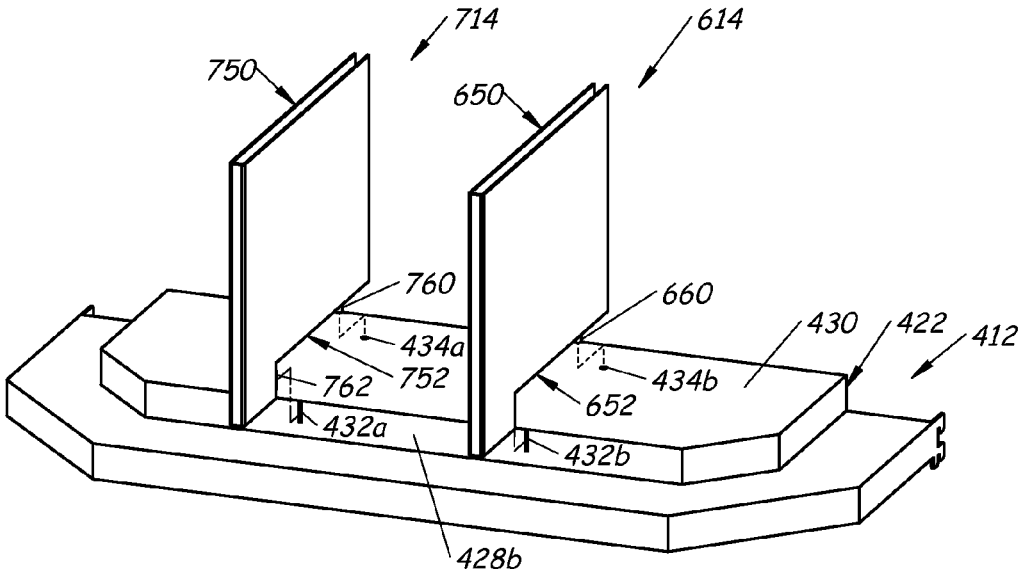
FIGS. 16-18 illustrate the exemplary set of dividers of FIGS. 14 and 15 being mounted to a tiered support structure of the exemplary intermediate shelf illustrated in FIGS. 8-12.
Figure 17:
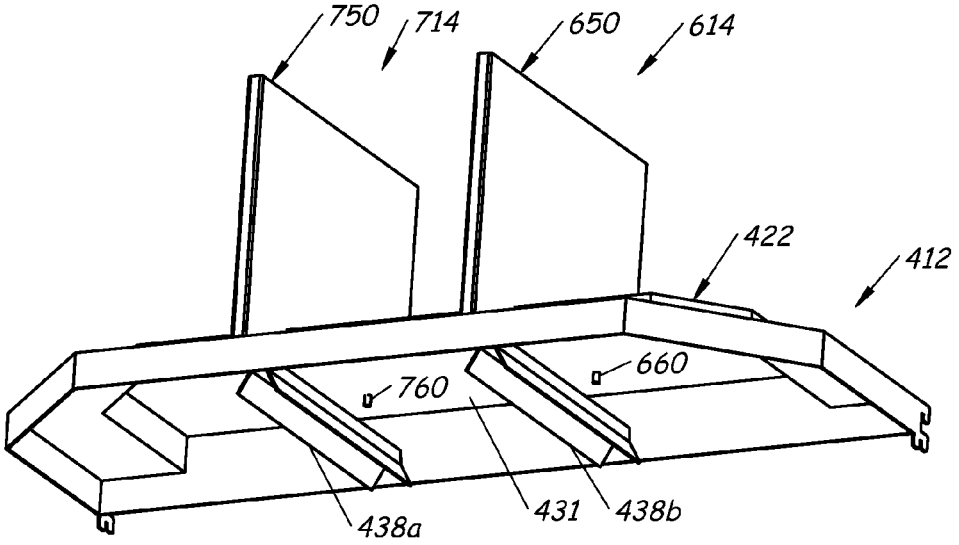
Figure 18:
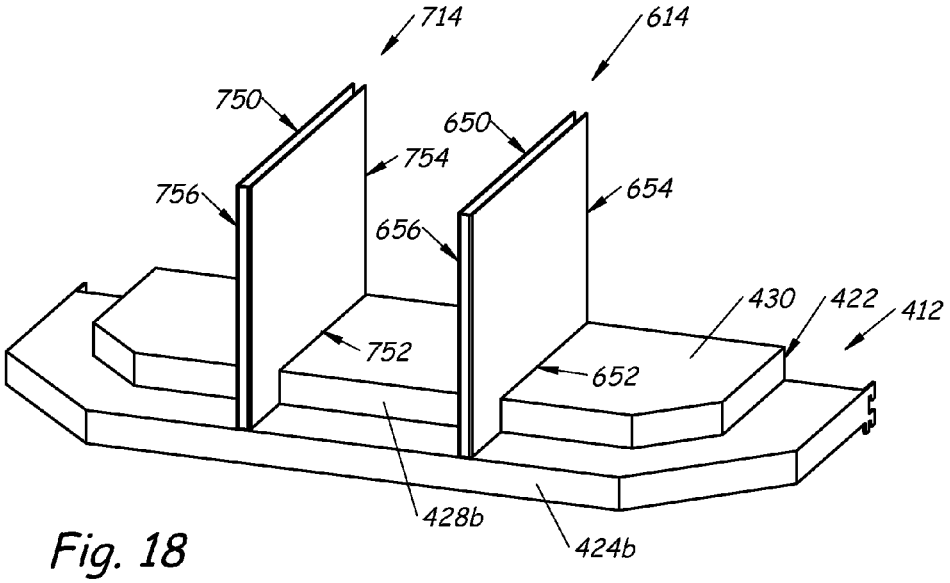

FIGS. 16-18 illustrate dividers 614 and 714 being mounted to a tiered support structure of exemplary intermediate shelf 412 illustrated in FIGS. 8-12. As illustrated, dividers 614 and 714 are mounted to riser 422 such that divider 614 and divider 714 are spaced apart from each other and extend from fixed ends 652 and 752 to free ends 650 and 750. More specifically, fixed end 652 of divider 614 is mounted to riser 422 by fastening fastener 660 through hole 434*b* in upwardly facing support surface 430 and inserting tab 662 (not shown in FIGS. 16-18) into slot 432*b* in front facing surface 428*b* of riser 422. Fixed end 752 of divider 714 is mounted to riser 422 by fastening fastener 760 through hole 434*a* in upwardly facing support surface 430 and inserting the tab 762 into slot 432*a* in front facing surface 428*b* of riser 422.

As illustrated in FIG. 17 and in one embodiment, threaded screws 660 and 760 are inserted through holes 434*b* and 434*a*, respectively, so that their ends are located above guides 438*b* and 438*a*, respectively. In one embodiment, wing nuts or the like can be used to attach to the ends of screws 660 and 760 to hold dividers 614 and 714 in place. The distance between a bottom facing support surface 431 of riser 422 and the tops of guides 438*a* and 438*b* is great enough so that wing nuts can be manually threaded with screws 660 and 760.

As illustrated in FIG. 18 and in one embodiment, when dividers 614 and 714 are secured to riser 422, back ends 654 and 754 of dividers 614 and 714 are flush with the back of intermediate shelf 412. As illustrated in FIG. 18 and in one embodiment, when divider 614 and 714 are secured to riser 422, front ends 656 and 756 of dividers 614 and 714 are flush with front facing surface 424*b* of main deck 420 of intermediate shelf 412.

Figure 19:
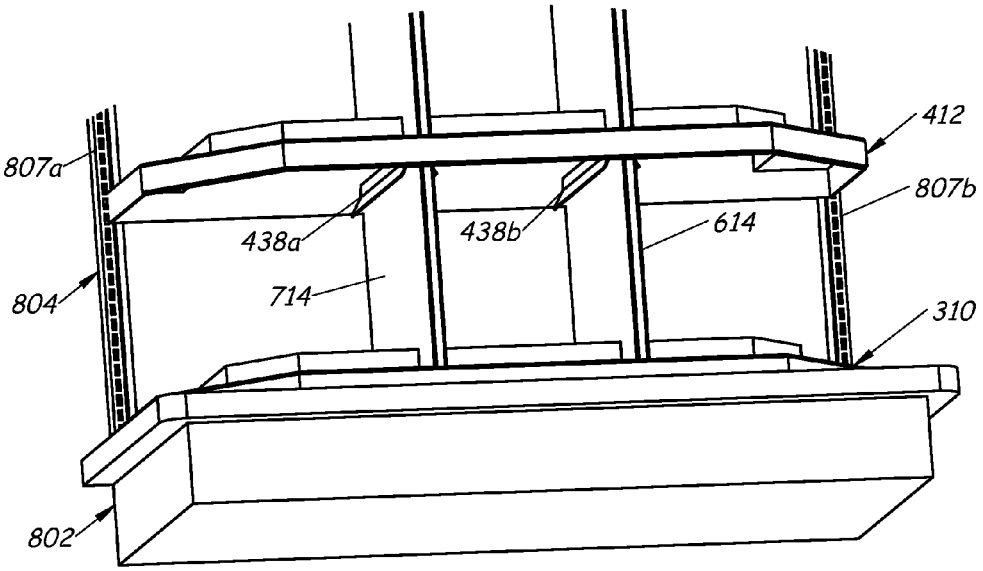
FIG. 19 illustrates a bottom perspective view of the exemplary bottom shelf illustrated in FIGS. 3-7 and the exemplary intermediate shelf illustrated in FIGS. 8-12 secured to an end wall.

FIG. 19 illustrates exemplary bottom shelf 310 illustrated in FIGS. 3-7 and exemplary intermediate shelf 412 illustrated in FIGS. 8-12 secured to an exemplary end wall 804 where exemplary end wall 804 can be end wall 104 illustrated in FIG. 1 in one embodiment or end wall 204 illustrated in FIG. 2. End wall 804 is coupled to a back of an exemplary base or base deck 802. As illustrated, bottom shelf 310 rests on base 802 and is secured to uprights 807*a* and 807*b* of end wall 804 and intermediate shelf is secured to uprights 807*a* and 807*b* at a location that is above and spaced apart from bottom shelf 310. Exemplary dividers 614 and 714 are mounted to and extend from fixed ends located on riser 322 of bottom shelf 310 to free ends that engage with guides 438*a* and 438*b* of intermediate shelf 412. Additional exemplary dividers 614 and 714 are mounted to and extend from fixed located on riser 422 of intermediate shelf 412 to free ends that engage with guides on an intermediate shelf located above intermediate shelf 412.

Figure 20:
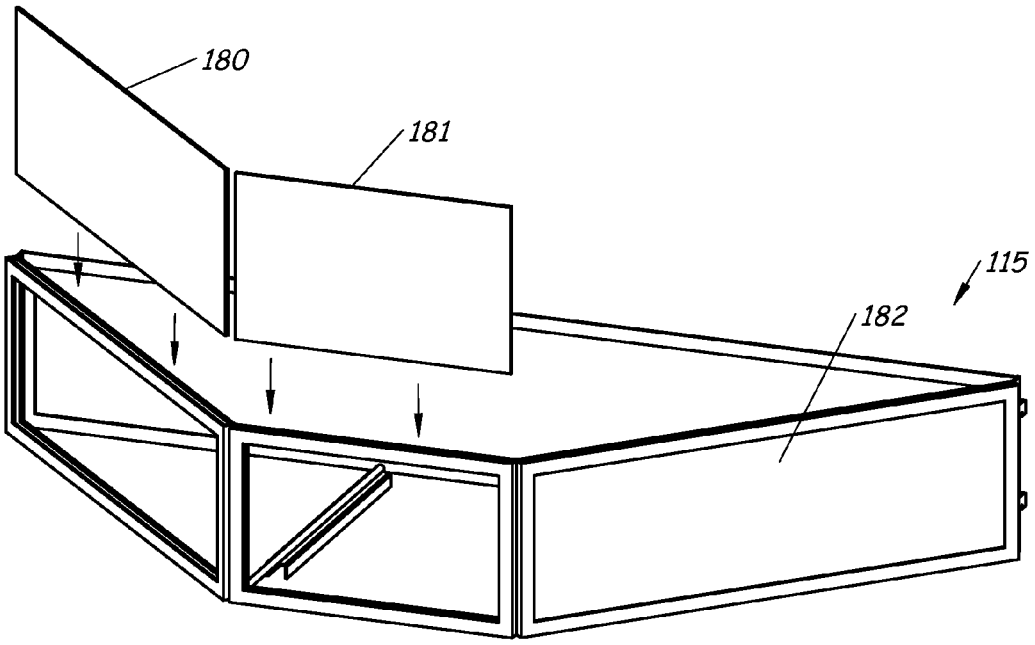
FIG. 20 illustrates a top perspective view of the header of FIGS. 1 and 15 receiving in-store marketing signs.
Figure 21:
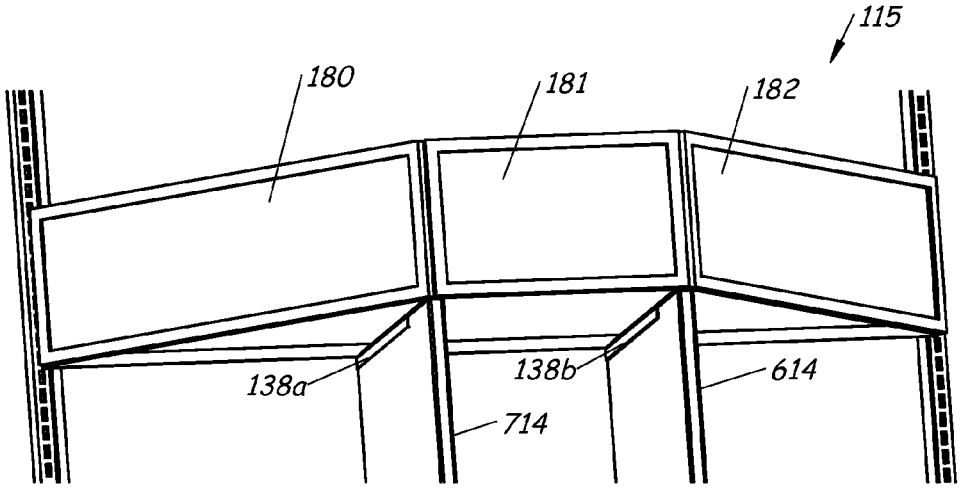
FIG. 21 illustrates a bottom perspective view of a portion of the end display of FIG. 1 showing the header of FIG. 15.

FIG. 20 illustrates header 115 receiving in-store marketing signs 180, 181 and 182. FIG. 21 illustrates header 115 holding in-store marketing signs 180, 181 and 182 including free ends of exemplary dividers 714 and 614 being received by guides 138*a* and 138*b*, respectively. As illustrated in FIG. 20, marketing sign 180 is inserted top down into sign frame members 142*a-d*, marketing sign 181 is inserted top down into sign frame members 142*e-h* and marketing sign 182 is inserted top down into sign frame members 142*i-l*.

With reference back to FIG. 1 and exemplary components in FIGS. 3-15, to assemble end display 100, a first set of dividers 114*a* and 114*b* are mounted to a tiered shelf structure or riser of bottom shelf 110 such that the first set of dividers 114*a* and 114*b* are spaced apart from each other and extend from their fixed ends to their free ends. A second set of dividers 114*c* and 114*d* are mounted on a tiered shelf structure or riser of intermediate shelf 112*a* (as shown in the example illustrated in FIGS. 16-18) such that the second set of dividers 114*c* and 114*d* are spaced apart from each other and extend from their fixed ends to their free ends. A third set of dividers 114*e* and 114*f* are mounted on a tiered shelf structure or riser of intermediate shelf 112*b* (as shown in the example illustrated in FIGS. 16-18) such that the third set of dividers 114*e* and 114*f* are spaced apart from each other and extend from their fixed ends to their free ends. A fourth set of dividers 114*g* and 114*h* are mounted to a tiered shelf structure or riser of intermediate shelf 112*c* (as shown in the example illustrated in FIGS. 16-18) such that the fourth set of dividers 114*g* and 114*h* are spaced apart from each other and extend from their fixed ends to their free ends. Fifth set of dividers 114*i* and 114*j* are mounted to a tiered shelf structure or riser of intermediate shelf 112*d* (as shown in the example illustrated in FIGS. 16-18) such that the fifth set of dividers 114*i* and 114*j* are spaced apart from each other and extend from their fixed ends to their free ends.

Bottom shelf 110 is then set on surface 103 of base deck 102 and secured to the pair of uprights 107*a* and 107*b* of end wall 104. Intermediate shelf 112*a* is secured to the pair of uprights 107*a* and 107*b* of end wall 104 above and spaced apart from the bottom shelf such that the free ends of the first set of dividers 114*a* and 114*b* mate with guides located on a bottom of intermediate shelf 112*a*. Intermediate shelf 112*b* is secured to the pair of uprights 107*a* and 107*b* of end wall 104 above and spaced apart from intermediate shelf 112*c* such that the free ends of the second set of dividers 114*c* and 114*d* mate with guides located on a bottom of intermediate shelf 112*b*. Intermediate shelf 112*c* is secured to the pair of uprights 107*a* and 107*b* of end wall 104 above and spaced apart from intermediate shelf 112*b* such that the free ends of the third set of dividers 114*e* and 114*f* mate with guides located on a bottom of intermediate shelf 112*c*. Intermediate shelf 112*d* is secured to the pair of uprights 107*a* and 107*b* of end wall 104 above and spaced apart from intermediate shelf 112*c* such that the free ends of the third set of dividers 114*e* and 114*f* mate with guides located on a bottom of intermediate shelf 112*d*.

To complete the assembly of end display 100, header 115 is then secured to the pair of uprights 107*a* and 107*b* of end wall 104 above and spaced apart from intermediate shelf 112*d* such that the free ends of the fifth set of dividers 114*i* and 114*j* mate with guides located on a bottom of header 115.

With reference back to FIG. 2 and exemplary components in FIGS. 3-15, to assemble end display 200, a first set of dividers 214*a* and 214*b* are mounted to a tiered shelf structure or riser of bottom shelf 210 such that the first set of dividers 214*a* and 214*b* are spaced apart from each other and extend from their fixed ends to their free ends. A second set of dividers 214*c* and 214*d* are mounted on a tiered shelf structure or riser of intermediate shelf 212*a* (as shown in the example illustrated in FIGS. 16-18) such that the second set of dividers 214*c* and 214*d* are spaced apart from each other and extend from their fixed ends to their free ends. A third set of dividers 214*e* and 214*f* are mounted on a tiered shelf structure or riser of intermediate shelf 212*b* (as shown in the example illustrated in FIGS. 16-18) such that the third set of dividers 214*e* and 214*f* are spaced apart from each other and extend from their fixed ends to their free ends.

Bottom shelf 210 is then set on surface 203 of base deck 202 and secured to the pair of uprights 207*a* and 207*b* of end wall 204. Intermediate shelf 212*a* is secured to the pair of uprights 207*a* and 207*b* of end wall 204 above and spaced apart from the bottom shelf such that the free ends of the first set of dividers 214*a* and 214*b* mate with guides located on a bottom of intermediate shelf 212*a*. Intermediate shelf 212*b* is secured to the pair of uprights 207*a* and 207*b* of end wall 204 above and spaced apart from intermediate shelf 212*a* such that the free ends of the second set of dividers 214*c* and 214*d* mate with guides located on a bottom of intermediate shelf 212*b* and such that the free ends of the third set of dividers 214*e* and 214*f* remain free.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An end display comprising:

a base;

an end wall coupled to a rear of the base;

a bottom shelf located on the base and secured to the end wall, the bottom shelf including a top having a tiered shelf structure;

at least one intermediate shelf spaced apart from the bottom shelf and secured to the end wall, each intermediate shelf including a top having a tiered shelf structure and a bottom having a set of guides; and at least one set of dividers having bottom ends that are mounted to the tiered shelf structure of the bottom shelf with fasteners and top ends that mate with the set of guides on the bottom of the at least one intermediate shelf;

wherein each of the set of guides includes a pair of legs that protrude downwardly relative to the bottom of the at least one intermediate shelf so that the top of each of the dividers is received between one of the pair of legs.

2. The end display of claim 1, wherein the tiered shelf structure of the bottom shelf and the tiered shelf structure of the at least one intermediate shelf comprise a main deck and a step deck that is raised above the main deck, each of the main deck and the step deck including front facing surfaces and an upwardly facing support surface.

3. The end display of claim 2, wherein the step decks of each of the bottom shelf and the at least one intermediate shelf comprise a set of slots that extend through one of the front facing surfaces of the step deck, wherein each slot receives a tab located on each of the dividers.

4. The end display of claim 2, further comprising a set of holes that extend through the upwardly facing support surface of the step deck of the bottom shelf and a set of holes that extend through the upwardly facing support surface of the step deck of the at least one intermediate shelf, wherein each set of holes receive the fasteners that are connected to the dividers.

5. The end display of claim 1, where the at least one intermediate shelf comprises a plurality of intermediate shelves spaced apart from each other and secured to the end wall.

6. The end display of claim 5, wherein the at least one set of dividers comprises a plurality of sets of dividers, wherein the bottom ends of each set of dividers are mounted to one of the bottom shelf or one of the plurality of intermediate shelves.

7. The end display of claim 6, wherein a set of dividers mounted to an uppermost intermediate shelf comprise a height that is less than a height of the other sets of dividers.

8. The end display of claim 6, further comprising a header spaced apart from an uppermost intermediate shelf on the end wall and secured to the end wall, the header including sign frame members for supporting front facing marketing signs and bottom frame members having a set of guides.

9. The end display of claim 8, wherein the top ends of one set of dividers mate with the set of guides on the bottom of the header.

10. An end display comprising:

a first product support assembly having a shelf deck and at least one riser;

a plurality of second product support assemblies spaced apart from each other and located above the first product support assembly, wherein each second product support assembly includes a shelf deck and at least one riser and provides upwardly facing product support surfaces and at least one downwardly facing channel; and a plurality of partitions, wherein at least one of the partitions is mounted to the riser of the first product support assembly and mates with the at least one downwardly facing channel of one of the second product support assemblies and wherein at least one of the partitions is mounted to the riser of one of the second product support assemblies and mates with the at least one downwardly facing channel of another one of the second product support assemblies;

wherein the first product support assembly and the plurality of second product support assemblies are secured to uprights on an end wall of the end display; and wherein each of the plurality of partitions are mounted to the risers of the first product support assembly or one of second product support assemblies with fasteners.

11. The end display of claim 10, wherein one of the second product support assemblies comprises an uppermost second product support assembly and wherein at least one of the partitions is mounted to the riser of the uppermost second product support assembly and comprises a height that is less than a height of the at least one partition that is mounted to the first product support assembly.

12. The end display of claim 10, further comprising a header spaced apart from one of the second product support assemblies that comprises an uppermost second product support assembly, the header including sign frame members for holding marketing signs and at least one downwardly facing channels.

13. The end display of claim 12, wherein at least one of the partitions is mounted to the riser of the uppermost second product support assembly and mates with the at least one downwardly facing channel of the header.

14. A method of assembling an end display, the method comprising:

mounting a first set of dividers to a tiered shelf structure of a bottom shelf such that the first set of dividers are spaced apart from each other and extend from fixed ends to free ends;

mounting a second set of dividers on a tiered shelf structure of an intermediate shelf such that the second set of dividers are spaced apart from each and extend from fixed ends to free ends;

setting the bottom shelf on a base deck of the end display and securing the bottom shelf to an end wall coupled to a rear of the base deck of the end display; and securing the intermediate shelf to the end wall above and spaced apart from the bottom shelf such that the free ends of the first set of dividers mate with guides located on a bottom of the intermediate shelf, wherein securing the bottom shelf to the end wall comprises securing the bottom shelf to a pair of uprights that support an end panel, the pair of uprights including slots for receiving brackets coupled to the bottom shelf.

15. The method of claim 14, wherein securing the intermediate shelf to the end wall comprises securing the intermediate shelf to a pair of uprights that support the end panel, the pair of uprights including slots for receiving brackets coupled to the intermediate shelf.

16. The method of claim 14, wherein mounting the first set of dividers to the tiered shelf structure of the bottom shelf comprises fastening bottom ends of the first set of dividers to a top surface of the tiered support structure of the bottom shelf using fasteners and inserting tabs located on the first set of dividers into slots on a front face of the tiered support structure of the bottom shelf.

17. The method of claim 14, wherein mounting the second set of dividers to the tiered shelf structure of the intermediate shelf comprises fastening bottom ends of the second set of dividers to a top surface of the tiered support structure of the intermediate shelf using fasteners and inserting tabs located on the second set of dividers into slots on a front face of the tiered support structure of the intermediate shelf.

* * * * *